US005222930A

United States Patent [19]

Bold, Jr.

[11] Patent Number: 5,222,930

[45] Date of Patent: * Jun. 29, 1993

[54] INERTIAL FORCE EXERCISE DEVICE HAVING DENSE BODY EXTREMITIES

[76] Inventor: Thomas P. Bold, Jr., 8603 Cross Chase Ct., Fairfax Station, Va. 22039

[ * ] Notice: The portion of the term of this patent subsequent to Oct. 4, 2005 has been disclaimed.

[21] Appl. No.: 685,198

[22] Filed: Apr. 15, 1991

Related U.S. Application Data

[63] Continuation-in-part of Ser. No. 375,405, Oct. 3, 1988, abandoned, which is a continuation-in-part of Ser. No. 632,824, Jul. 20, 1984, Pat. No. 4,900,017.

[51] Int. Cl.[5] ..... A63B 21/22

[52] U.S. Cl. ..... 482/132; 482/108

[58] Field of Search ..... 272/67, 68, 122, 117, 272/123, 127, 128; 482/44, 45, 46, 47, 106, 93, 108, 110, 131, 132

[56] References Cited

U.S. PATENT DOCUMENTS

| | | | |
|---|---|---|---|
| 1,438,804 | 12/1922 | Albizu | 482/108 |
| 1,672,944 | 6/1928 | Jowett | 272/122 |
| 1,991,520 | 2/1935 | Postl | 272/122 |
| 2,676,802 | 4/1954 | O'Brien | 272/128 X |
| 3,134,590 | 5/1964 | Young | 272/122 X |
| 3,403,906 | 10/1968 | Burzenski | 272/127 |
| 3,482,835 | 12/1969 | Dean | 272/128 X |
| 3,617,056 | 11/1971 | Herbold | 272/128 X |
| 3,797,824 | 3/1974 | Osbourne | 272/127 |
| 3,809,393 | 5/1974 | Jones | 272/127 |
| 3,825,253 | 7/1974 | Speyer | 272/123 |
| 4,134,584 | 1/1979 | Rosenbusch | 272/127 X |
| 4,171,805 | 10/1979 | Abbott | 272/127 |
| 4,361,324 | 11/1982 | Baroi | 272/123 |
| 4,455,020 | 6/1984 | Schnell | 482/106 |
| 4,775,147 | 10/1988 | Bold, Jr. | 272/127 |

FOREIGN PATENT DOCUMENTS

| | | | |
|---|---|---|---|
| 2529790 | 1/1984 | France | 272/122 |
| 598554 | 10/1959 | Italy | 272/122 |
| 1138176 | 2/1985 | U.S.S.R. | 272/122 |

*Primary Examiner*—Robert Bahr

[57] ABSTRACT

This invention relates to an inertial force accommodating resistance exercise device and method having dense body extremities and an associated method of exercise for using the device. The subject device develops fitness for the user by providing the capability to acceleratedly translate inertial mass across a surface in order for the user to experience accommodating, inertial force resistance. In its preferred embodiment, the subject device is a two-wheeled body with the majority of the device's mass being concentrated in the body's extremities resulting in the extremities being denser than the wheels or the central section of the body. Each of the extremities comprise an inertial mass and axle. The device's wheels are mounted at their hubs on the axles in a mutually parallel posture along the length of the body at opposite ends of the body's central section with the diameters of the wheels perpendicular to the body's center line. Further, the wheels and body's central section are constructed in a manner to minimize their density while, at the same time preserving their operational integrity. The method of exercise involves the user grasping the central section of the device and accelerating the device on a floor or wall to experience the resistance of translational inertial forces.

32 Claims, 2 Drawing Sheets

INERTIAL FORCE EXERCISE DEVICE HAVING DENSE BODY EXTREMITIES

This Application is a Continuation-in-Part Application of U.S. Pat. application Ser. No. 07/375,405, filed Oct. 3, 1988, now abandoned, which in turn is a continuation-in-part of Ser. No. 06/632,824, filed Jul. 20, 1984, now U.S. Pat. No. 4,900,017.

BACKGROUND OF THE INVENTION

This invention relates to an inertial force, accommodating resistance exercise device and method. More specifically, this invention relates to a device and method for generating an opposing force to exercise a user with accommodating resistance primarily through a controlled effort employed by a user of the instant device to overcome inertia of a mass in translation when the device is repeatedly accelerated and decelerated during surface oscillations.

Exercise devices have in common the necessity of enabling a user to experience an opposing force in order to provide resistance to the muscles of the body for the purpose of exercising. This necessity is predicated upon Newton's third law of motion which states that for every force that is exerted by one body on another, there is an equal and opposite force exerted by the second body on the first. The muscles of the body and an exercise device demonstrate the application of this law in an action/reaction combination during the performance of exercise.

With respect to the reaction half of the combination, exercise devices have in the past been designed to take advantage of a variety of forces. Gravity force devices are designed to cause a user to move weight against an opposition provided by the force of gravity, as in the case of barbells or a universal gym. Resilience force devices are designed to cause a user to deform an object such as a spring or elastic band whose resilience properties oppose action by the exerciser. Pneumatic force devices are designed to cause a user to compress or exhaust air in a chamber in order to create opposition, as in the case of most rowing machines. Rotational inertia force devices are designed such that a user experiences resistance when rotation of a metal disk or a flywheel is initiated, as in the case of Nordic ski machines. Friction force devices are designed to cause a user to overcome friction of two interacting surfaces such as between a strap and a flywheel of an exercise cycle. Mechanically-determined force devices are designed to cause a user to overcome the resistance of levers or cables as determined by a speed governor, as in the case of a Cybex machine or a Mini-Gym.

By taking advantage of such forces, exercise devices in the past have enabled a user to perform three basic types of exercise: isotonic, isometric, and accommodating resistance.

Gravity force and resilience force devices are generally used to perform isotonic exercise wherein a muscle shortens and lengthens with varying tension while overcoming and releasing a constant load. In isotonic exercise, the weight or resistance used to exercise is limited to the force that can be overcome at the position or angle where the muscles are weakest in a range of motion. The tension on the muscle is maximal only at that position or angle. In this type of exercise, the speed of motion is relatively slow compared to the rapid movements needed for many sports activities.

Gravity force and resilience force devices are also suited to perform isometric exercise wherein a muscle is given static tension by holding the device in a fixed position. This type of exercise is also commonly performed by pressing against any immovable object. In isometric exercise, there is no motion, and significant gains in strength are specific only to the particular angle or position chosen for the contraction of the muscle.

Exercise devices which take advantage of pneumatic force, friction force, mechanically—determined force, etc., are generally used to perform accommodating resistance exercise (also referred to as isokinetic exercise). In accommodating resistance exercise tension on a muscle varies in direct proportion to the effort expended by the user and is controlled rather than being predetermined by a fixed resistance. Accommodating resistance exercise allows for maximum contraction or tension of a muscle at all joint angles over a full range of joint motion used to perform the exercise and also allows for the speed of movement required for various sports activities to be duplicated by teaching a more efficient activation of muscles by the nervous system. Accommodating resistance exercise, as the basis for a training program, has been rated by many as being superior to isotonic and isometric exercise with respect to rate of strength gain, rate of endurance gain, strength gain over a range of motion, adaptability to specific movement patterns, least possibility of injury, and skill improvement.

In using exercise devices which have been designed to provide accommodating resistance, minimum resistance is experienced when a speed of operation is slow and a greater resistance is experienced when a speed of operation is increased. These devices allow the body to work hard in positions where the body is structured to do hard work and to ease off in positions where the skeletal-muscular system is weak. Rowing machines which employ a pneumatic force to provide opposition, exercise cycles which employ rotational inertia and friction forces to provide opposition, and a Cybex machine which employs a mechanically-determined force to provide opposition are examples of exercise devices which have been designed to take advantage of various opposing forces to enable a user to perform accommodating resistance exercise.

Although machines known in the past have achieved a degree of user acceptance in accommodating resistance training, it would be desirable to create an exercise device capable of taking advantage of an inertial force which is the result of rectilinear or curvilinear translation of an object in order to accommodating resistance exercise routines. This type of inertial force is the resistance of an object due to its inertia when the object is accelerated linearly without rotation. (Hereafter, reference to an inertial force will mean an inertial force which is the result of translation of a mass. An inertial force which is the result of rotation of a mass will be so designated.)

An exercise device designed to take advantage of an inertial force is predicated upon what is perhaps the most fundamental property possessed by all objects—inertia. The inertia of an object is a measure of the difficulty in changing the state of rest or motion of the object.

The principles which provide the theoretical basis for an exercise device which enables a user to create and overcome an inertial force to perform accommodating resistance exercise are expressed in Newton's first and second laws of motion. The first law is sometimes referred to as the law of inertia and states that a body continues in a state of rest or motion in a straight line unless it is compelled to change that state by an external force exerted upon it. In other words, because objects possess inertia, an object at rest tends to remain at rest, and an object in motion tends to remain in motion. If the state of rest or motion of an object is altered (start, stop, change direction), a force is needed to accelerate/decelerate the object.

The relationship between an object, force, and acceleration may be expressed in Newton's second law of motion which states that a body acted upon by an external force undergoes an instantaneous acceleration proportional to and in the direction of the force applied to the body. According to this law, the magnitude of force for a given acceleration depends upon the inertia of the object as measured by the object's mass. Simply expressed, the force "F" required to give a mass "m" an acceleration "a" is proportional to both "m" an "a", or $F=ma$.

As previously noted, Newton's third law states that the action of a force to cause acceleration results in a reaction of an equal and opposite force. This reaction force is an inertial force. The equation, $F=ma$, indicates that the magnitude of the inertial force can be modified by varying the size of the mass, while the rate of acceleration remains constant. It indicates the inertial force can be modified by varying the rate of acceleration while the size of the mass remains constant. Controlling the rate of acceleration causes the resistance offered by the inertial force to be accommodating.

An exercise device created to utilize inertial force to provide accommodating resistance would be particularly appropriate for physical conditioning and sports training because inertial forces are commonly experienced in moving one's body and in giving motion to external objects. Inertial forces in physical activities are easy to distinguish by the requirement that they come into existence when initiating, maintaining, and terminating motion. Inertial forces provide the predominant resistance when one gives motion to external objects in activities such as throwing or kicking a ball, swinging a racket or bat, blocking or tackling a player in football, etc. They provide the predominant resistance when one gives rapid motion to one's body or its parts in activities such as jumping, leaping, running, swimming, skating, etc.

One of the benefits of inertial force training has to do with the development of cardiovascular or aerobic fitness. Aerobic fitness is the ability of the heart, blood, and blood vessels to transport oxygen to muscle cells, process the oxygen in those cells, and carry off the resulting waste products. Aerobic fitness is considered by many to be the most important component of overall fitness. Physical activities which produce strong, opposing inertial forces through the rapid motion of one's body advantageously improve and sustain aerobic fitness.

Inertial forces are involved in most popular physical activities used for cardiovascular development. In running, they are involved in accelerating from a stationary position, in the swinging of the arms and legs, and in the dynamics of landing and takeoff as the body is propelled across a surface by the legs. In swimming, inertial forces are generated in overcoming the inertia of the body in the water, in swinging and kicking the legs, and in overcoming the inertia of the water in repeated stroking and kicking. In rowing, inertia is involved in overcoming the stationary position of a boat, in the resistance offered by the mass of oars, and in overcoming the inertia of water with the oars as the boat is rowed.

In a physiological manner similar to the above popular physical activities, an inertial force exercise device would advantageously contribute to aerobic fitness by featuring an opposition of inertial force in exercises which are continuous and rhythmic and which involve a user's major muscle groups. The use of such a device is further analogous to engaging in aerobic activities such as described above in that the strength of the inertial force can be controlled by varying the rate at which actions are performed, thereby making possible a relatively long—duration participation essential for aerobic conditioning. The aerobic benefit from a device which provides for accommodating resistance is in contrast to an exercise device which solely uses a noninertial force, such as gravity, to create an opposing force required for exercise wherein the weight being lifted is constant.

In addition to aerobic benefit, another benefit has to do with the development of flexibility. Flexibility is the range of motion possible at joints. Joint flexibility is an important element of general health and physical fitness. Adequate flexibility is desirable for all individuals and is considered to be a possible preventor of low back pain and some of the aches and pains that accompany aging. In addition, improved performance in many sports activities and the prevention of injury and soreness can result from an appropriate program of flexibility development. Flexibility is joint and activity specific. Physical activities which require the greatest range and frequency of movement about a joint and which require significant effort to overcome inertial forces in accomplishing the movement are those which contribute most to flexibility. In this regard, swimming, handball, squash, Nordic and Alpine skiing, and tennis are rated very highly. Therefore, the creation of an inertial force exercise device would provide the user opportunities to contribute to the flexibility of the joints of arms and legs through the opposition of inertia to muscles, ligaments, and tendons. Swinging and reaching motions would closely approximate the rapid motions in the physical activities rated highly for their contribution to flexibility.

Still another benefit of inertial force training has to do with the development of muscular strength and endurance. Muscular strength is the amount of force that can be exerted by a single contraction of particular muscles. Muscular endurance is the length of time an activity can be sustained by particular muscles. Developing and maintaining muscular strength and endurance is best achieved by physical activities which permit the maximum contraction of effort of a muscle through the full range of joint motion and which permit the contraction to be repeated. Physical activities, particularly those which involve rapid and repeated motion by the limbs of the body or which involve the limbs to give rapid and repeated motion to external objects, permit the full exertion of body's muscular capacity in overcoming the inertia of the limb or the limb in combination with an external object. Therefore, physical activities that overcome strong inertial forces provide a means of increasing and sustaining muscular strength and endurance in a way considered to be most desirable.

Examples of activities which permit a maximum and repeated contraction of a muscle or muscle group through a range of motion required to perform the activity include swimming, wherein the limbs may experience maximum resistance from the water; rowing, wherein maximum resistance may be experienced from the water through the oars; skating, wherein the legs may experience maximum resistance in pushing off against a surface; boxing, wherein the arms may experience maximum resistance in swinging and striking; etc.

Physical activities such as described above permit a maximum contraction of muscles through a specified range of motion because the resistance provided by inertial forces is accommodating. The magnitude of the inertial force, or opposing force is dependent on the acting force of the body. That is to say, the resistance experienced by the muscles at any point during an acceleration will be dependent upon the force the muscles are able to exert at that point. The resistance is accommodating in proportion to the changing muscular capability at every point in the range of motion. Accommodating resistance during these activities allows all muscles and muscle groups, irrespective of their relative strength, to undergo maximum contraction during an entire range of motion and for these contractions to be repeated, thereby providing for muscular strength and endurance. Accordingly, it would be highly desirable to create an exercise device which would enable a user to experience the same opportunities to develop and maintain muscular strength and endurance through accommodating resistance offered by an inertial force as physical activities such as those described above.

The invention which is the subject of the instant patent is a device of a mass translation type which has been created primarily to take advantage of translational inertial force as the opposing force necessary for accommodating resistance exercise to provide the benefits described above having to do with developing and maintaining aerobic fitness, flexibility, muscular strength, and muscular endurance.

The subject invention falls in the category of surface—operated exercise devices which are generally rolled on a surface to perform exercises.

In the past, inventions in this category have most often been designed to take advantage of gravity as the means of establishing the opposing force necessary for exercise. One design comprises a single wheel on a shaft. Another design comprises two double-wheeled, foot-mounted devices. Other designs comprise rollable devices—one for each hand—with unique features such as the use of tracks, the use of brakes, the use of resistance springs, the use of casters, etc. Gravity becomes the opposing force as these devices are used in performing exercise to support, raise, or lower the body of the user in relation to the surface.

In addition to taking advantage of gravity as the opposing force, other inventions in this category have been designed to take advantage of the resistance offered by the inertia of a rotating mass. One design comprises two disk-shaped weights as the wheels of the device. Another design comprises spherically-shaped, rotatable weights as the means for rolling the device.

These previous inventions in the category of surface-operated exercise devices require a significant downward force vector to be applied and maintained as a user exerts effort to support the weight of the body and/or to overcome the rotational inertia of the weighted rotating members. This requirement limits the range of exercise that may be performed and the benefits that may be derived therefrom. It limits the freedom and rapidity with which these devices may be moved on a surface. It limits the community of users to those already in the possession of sufficient upper body strength to exert the pressing force required to support the body weight in various attitudes and positions and to rotate mass and to change the direction of rotation.

Still another invention in the past has been designed to be rolled by a patient in order to strengthen a limb weakened and impaired by disease or injury. The design of this invention differs significantly from the subject invention and does not permit rapid acceleration to experience an inertial force without the generation of torque or turning over the device. This invention of the prior art is constraining and limiting with respect to ease of use, versatility, and application.

Yet still another invention in the past has been designed for the purposes of grip strengthening and weight lifting. The disclosure of this invention shows a dumbbell whose largest diameter plates have protective rubber belts and whose smaller diameter plates are mounted outside the largest diameter plates for convenient exchange in varying the resistence in accordance with the demands of the exercise. If one were to roll this device for the purpose of exercise, a purpose not described in the disclosure, the largest diameter plates would offer rotational inertial resistence and not that of a translational inertial force as is the case in the use of the subject invention.

The difficulties suggested in the preceding are not intended to be exhaustive, but rather to indicate a lack of appreciation in the prior art for significance of surface-operated, translational inertial force devices and methods. Other noteworthy problems may also exist; however those presented above should be sufficient to demonstrate that devices which use only gravity and/or the inertial of rotating mass as a means of establishing opposition will admit to further improvement.

A significant improvement in the art may be appreciated by reference to applicant's above identified Ser. No. 375,405. Notwithstanding the advances provided by applicant's previously disclosed accommodating resistance exercise device, in certain instances, room for worthwhile improvement remains.

More specifically, considering the invented device to be a body and two wheels which can be acceleratedly rolled through the device's center of gravity to experience the resistance of translational inertial forces, further practice and experience have demonstrated that, when the mass of the extremities of the body is denser than the mass of the wheels and when the mass of the extremities is denser than the mass of the central section of the body, the device can be operated effectively, efficiently, and smoothly for the following reasons:

a. Having the density of the mass of the extremities of the body greater than the density of the mass of the wheels and, further, having the wheels constructed in a manner so as to minimize the density of their mass optimizes the operating condition wherein the the user's experience of translational inertial resistance from the linear acceleration and deceleration of the mass of the extremities is enhanced and the user's experience of rotational inertial resistance from the accelerated and decelerated torquing of the mass of the wheels is negated when the device is rolled back and forth by means of the central section of the body.

The purpose of the invention is to enable the user to experience translational inertial forces in their greatest purity in so much as it is theoretically possible. Given that each of the extremities of the body and each of the wheels exists in a finite volume, the purity of the experiencing of translational inertial resistance is most greatly assured when the wheels are as less dense as possible while still maintaining their operational integrity and when the extremities of the body are denser than the wheels.

Through such a construction, the device enables the user to a experience translational inertial force when rolling the device on a surface perpendicular to the force of gravity which is most greatly akin to what would be practically possible only in the weightless environment of outer space. In accelerating and decelerating the device on such a horizontal surface, the user finds that the experiencing of resistance from rotational inertial forces from having to increase and decrease the rate of rotation of the wheels is neutralized and the experiencing of resistance of translational inertial forces from the denser mass of the body's extremities is enhanced.

b. Having the density of the mass of the extremities of the body greater than the density of the mass of the body's central section and, further, having the central section constructed in a manner so as to minimize the density of its mass optimizes the operating condition wherein the greatest mass is positioned adjacent to the wheels thereby enabling the user to more easily determine the device's center of gravity and better control the wheels in a stable, parallel posture when the device is acceleratedly and deceleratedly rolled on a surface by means of the body's central section.

In practice, a user may desire to accelerate only a body of moderate mass on the wheels because of the requirements of the exercise routine or because of the user's lack of strength or conditioning. The moderate mass may be evenly distributed throughout the body's extremities and central section or it may be primarily incorporated in either the extremities or the central section. When the moderate mass is evenly distributed or when it is primarily concentrated in the body's central section, the user is not able to cleanly detect and accelerate through the device's center of gravity and the device has a tendency to wobble and become unstable during acceleration and deceleration.

However, when the majority of the moderate mass is distributed equally in the body's extremities, the user gains the ability to readily appreciate the center of gravity during acceleration. Positioning the majority of the body's mass in the extremities creates a structure analogous to a balance wherein the hand of the user at the central section senses the center of gravity as a fulcrum during rapid acceleration of the device. The user is thereby able to more advantageously achieve the uniform translation the body where each extremity is accelerated at an identical rate of speed in a mutually parallel posture, the center line of the device being maintained perpendicular to the direction of acceleration, with the pleasing sensation that the extremities are tracking and without the unpleasant sensation that the extremities are wobbling or having a tendency to rotate about the device's center of gravity.

In view of design considerations having to do with density, this Continuation-in-Part Application discloses and claims an inertial force exercise device comprised of a body and two wheels, where the extremities of the device's body are denser than the device's wheels and the central section of the device's body, and an associated method of exercise.

OBJECTS OF THE INVENTION

It is therefore a general object of the invention to provide a novel inertial force exercise device with dense body extremities which will obviate or minimize disadvantages and/or limitations of previously known devices of the type previously described.

It is another general object of the invention to provide a novel inertial force exercise device with dense body extremities which will give an improved means of exercising to develop aerobic fitness, muscular strength, muscular endurance, and flexibility, primarily by taking advantage of an inertial force as the opposing force in performing accommodating resistance exercise.

It is a further general object of the invention to provide a novel inertial force exercise device with dense body extremities which will minimize difficulties of prior surface-operated devices through improvements in exercise techniques offered by mass in translation and the overcoming of inertial forces on a variety of surfaces.

It is a specific object of the invention to provide a novel inertial force exercise device with dense body extremities wherein an inertial mass may be translated on a surface such as a floor or wall in order to generate an inertial force to exercise the body as the device is repeatedly accelerated and decelerated in an oscillating pattern.

It is another object of the invention to provide a novel inertial force exercise device with dense body extremities wherein an inertial mass may be translated easily for the purpose of causing a continuous, rhythmic, and fluid series of actions and reactions in overcoming the inertia of the mass of the structure.

It is a further object of the invention to provide a novel inertial force exercise device with dense body extremities wherein an inertial mass may be varied through an uncomplicated mechanism.

It is yet another object of the invention to provide a novel inertial force exercise device with dense body extremities wherein the device allows an arm or leg a full range of motion during exercise with no interference.

It is still a further object of the invention to provide a novel inertial force exercise device with dense body extremities which permits a user to perform a series of exercises in a sitting, standing, kneeling or lying position on a floor or in a standing or lying position on a wall to strengthen all major muscle groups and develop flexibility, endurance, and aerobic capacity.

It is still another object of the invention to provide a novel inertial force exercise device with dense body extremities which is suitable as a training alternative for physical activities of the athletic variety because exercises using the device duplicate the requirements of those activities with respect to the coordination required, with respect to the muscles employed, with respect to the range of joint action, and with respect to the speed and resistance demands of the movement patterns.

It is yet still another object of the invention to provide a novel inertial force exercise device with dense body extremities which can be used for the general fitness of all age groups and the rehabilitation of injured or weakened limbs, joints, muscles, etc., because the user can vary the inertial force by varying the rate of acceleration of the device to perform accommodating resistance exercise in accordance with the condition and requirements of the user.

It is a further object of the invention to provide a novel inertial force exercise device with dense body extremities which allows a wide range of exercises which are easy to learn and to perform safely in a variety of settings such as a home, office, or gym environment.

It is another object of the invention to provide a novel inertial force exercise device with dense body extremities which is relatively affordable, portable, and versatile thereby providing a means for accomplishing overall fitness which is a significant alternative to more expensive and complex exercise devices available to consumers through home installation.

It is still another object of the invention to provide a novel inertial force exercise device with dense body extremities which is aesthetically pleasing and entertaining to use because of the continuous, fluid, and rhythmic oscillation of the limbs of the body during exercises analogous to limb movements in running, swimming, skating, etc.

It is yet another object of the invention to provide a novel inertial force exercise device with dense body extremities which offers significant advantages with respect to the simplicity of mechanical operation of the device, the economy of parts in the construction of the device, and the economy of cost in the mass production of the device.

It is also an object of the invention to provide a novel inertial force exercise device with dense body extremities in accordance with one or more of the above objectives where the extremities are denser than either the wheels of the device or the central section of the device's body in order to increase the smoothness of the device's operation and the pleasing sensation of the inertial resistance from uniformly translating the dense body extremities.

BRIEF SUMMARY OF A PREFERRED EMBODIMENT OF THE INVENTION

A preferred embodiment of the invention which is intended to accomplish at least some of the foregoing objects, comprises an inertial force exercise device having dense body extremities which includes a first wheel and second wheel operable to engage and roll upon a surface during an exercise routine connected to an inertial body with the wheels being mounted at the hubs, one at each extremity along the length of the body. Each extremity of the body comprises an axle and an inertial mass structure. The first and second wheels are pivotably mounted upon the axles for rotation with respect to the axles to permit the axles to be translated across a surface. The body has a central section for controlling the operation of the exercise device. One inertial mass structure is connected to the axle either inside or outside the first wheel and the other inertial mass structure is connected to the axle either inside or outside the second wheel in a parallel posture for accelerated translation with the axle and thereby providing inertial resistance to exercise a user's body and provide overall fitness. In the preferred embodiment the extremities are denser than the wheels and the body's central control section with the central section being a tube. Further, the elements of the extremities, the inertial masses and the axles are denser than the wheels and the body's central section.

THE DRAWINGS

Other objects and advantages of the present invention will become apparent from the following detailed description of the preferred embodiment thereof taken in conjunction with the accompanying drawings wherein.

Figure 4:
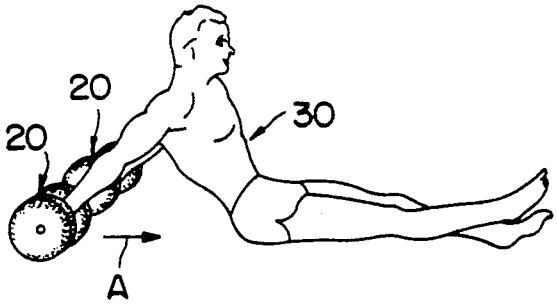
Figure 5:
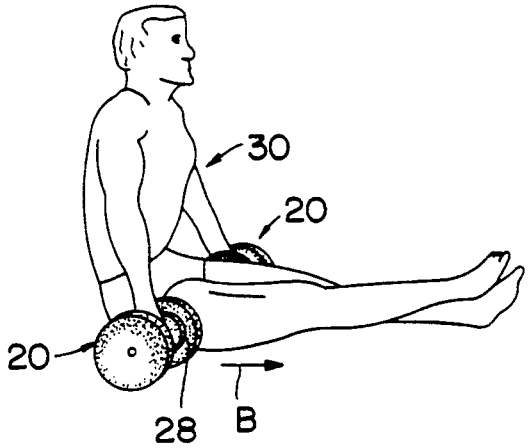
Figure 6:
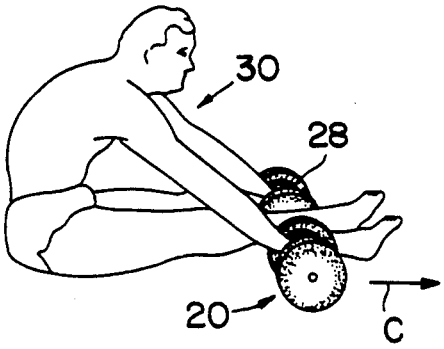

FIGS. 4–6 schematically disclose the use of an inertial force exercise device with dense body extremities to perform accommodating resistance exercise in in a smooth and efficient manner because the extremities of the device's body are denser than the devices wheels or the central section of the device's body.

DETAILED DESCRIPTION

Figure 1:
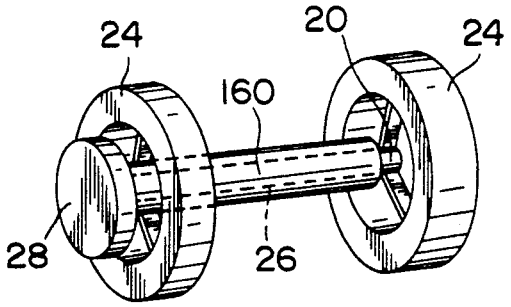
FIG. 1 is an overview of an inertial force exercise device having dense body extremities in accordance with the preferred embodiment of the invention where the inertial mass structures are outside the wheels.

Referring now to the drawings and particularly to FIG. 1 thereof, there will be seen an inertial force exercise device having dense body extremities in accordance with the preferred embodiment of the invention. In this embodiment, the exercise device includes first and second wheels 24 rotatably mounted in a parallel posture on axles 20 at extremities of the device's body. An inertial mass 28 is shown on the axle 20 outside the wheel 24. The central section 26 of the body of the device is shown to be a tube with a hollow space 160 in order to minimize its density.

Figure 2:
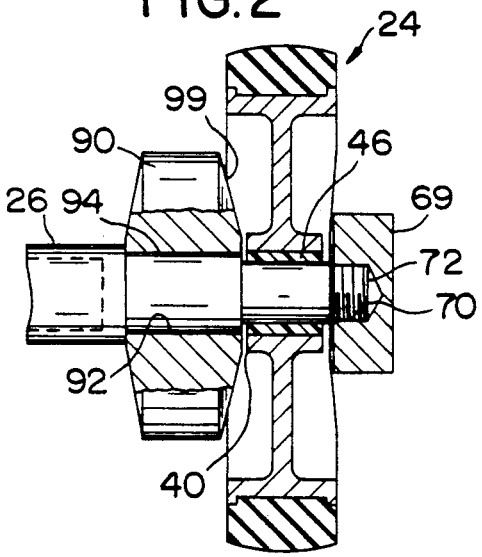
FIG. 2 is a partial cross-sectional view of one end of an inertial force exercise device which discloses the preferred embodiment of the invention wherein the inertial mass has been connected to the axle as a spacer inside the wheel by means of a smooth cylindrical bore.

FIG. 2 depicts one end of an inertial force exercise device having dense body extremities in accordance with the preferred embodiment of the invention wherein an inertial mass 90 is shown with an internal cylindrical bore 92 which is operably received upon a portion of axle 94. A wheel 24 is maintained upon the axle 94 by being positioned between the inertial mass 90 and the retainer 69 which has a threaded bore 70. The threads on the bore are dimensioned and sized to be compatible with threads on an axial extension 72 which projects outwardly from the end of the axle 94. The inertial mass 90 is fashioned with a sloping inner face 99 which provides a minimal rim of contact with the hub 40 and bearing sleeve 46 of the wheel 24. The central section 26 is depicted as hollow to minimize its density in relationship to the inertial mass 90.

Figure 3:
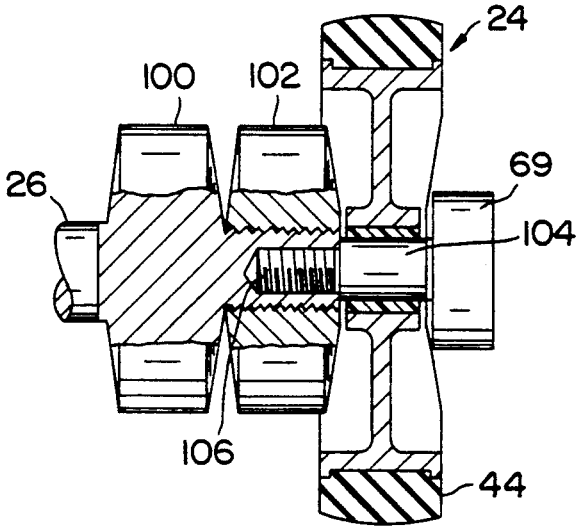
FIG. 3 is another cross-sectional view of the preferred embodiment of the invention wherein a first inertial mass has been integrally connected to the axle as a spacer inside the wheel and a second inertial mass has been connected to axle as a spacer inside the wheel by means of a threaded bore.

FIG. 3 depicts one end of an inertial force exercise device having dense body extremities in accordance with the preferred embodiment of the invention wherein two inertial mass are connected as spacers inside of wheel 24. A first inertial mass 100 is integrally joined with the axle 26 and a second inertial mass 102 is threadably received upon an extension of the shaft 26. Both of the first and second inertial masses, 100 and 102, are positioned in a posture inside of the generally lightweight plastic wheel 24. The wheel 24 is journaled upon an axial extension or stub 104 connected to a retainer 69. The stub 104 is threaded into an axial bore 106 of the axle 26 and is thereby joined with the axle and becomes a part of the axle. Inertial masses 100 and 102 are made of denser material than the central section 26.

FIGS. 4–6 schematically disclose a sequence of accommodating resistance exercise. More specifically, a user 30 is shown in FIG. 4 grasping the axles 26 of a pair of inertial force exercise devices with dense body extremities. The user 30 is seated upon a floor surface and has decelerated the inertial force exercise devices in leaning backward to reach the shown position and, in the process has translated the axles and inertial mass structure. From a rearward limit, the user 30 accelerates the subject exercise devices 20 forward in the direction of arrow "A" and thereby experiences an inertial force resistance from the inertial masses 28.

As seen in FIG. 5, the user 30 continues to accelerate the accommodating resistance exercise devices 20 of the instant invention in a forward direction as indicated by directional arrow "B" and continues to engage those muscles in the arm, torso, and legs needed to produce an acceleration force on the devices 20. Note that the inertial masses 28 are connected as spacers inside of the wheels of the device. In this exercise, the amount of user-initiated force is proportional to the mass of the device and the acceleration provided to it. Accordingly, the resistance which the user experiences is accommodating in the sense that the amount of the resistance of the inertial force is dependent and equal to the amount of the user-initiated force as determined by the rate of acceleration imparted by the user 30 and by the mass of the device 20.

FIG. 6 depicts the user 30 in a posture at approximately the other extreme end of the stroke wherein the exercise devices 20 are accelerated forward and in the direction of arrow "C" and will soon begin to be decelerated as contractions are actuated in the muscles of the arms, in the back of the legs. and back of the user.

In this one exercise routine, once the limit of the user's flexibility is achieved in a forward direction, the inertial force exercise devices 20 with dense body extremities are rapidly pulled in an opposite direction until the user has returned to the position depicted in FIG. 4. As stated above, the quality and quantity of the exercise are determined by the acceleration applied by the user and the mass of the exercise devices 20.

Note the close proximity of the devices to the user's legs and hips during this routine. The inertial masses 28 on the inside of the wheels prevents hammerlike contact of these masses with the user's legs during exercise. The user's arms from the rapidly turning wheels during the reaches to front and rear of the user and permit the user's hand maximum room on the axle for convenient operation.

In describing this invention of an inertial force exercise device with dense body extremities, reference has been made to the preferred embodiment and illustrative advantages of the invention having to do with the extremities of the devicep's body being denser than the devices wheels or the central section of the device's body. Those skilled in the art, however, and familiar with the instant disclosure of the subject invention, may recognize additions, deletions, modifications, substitutions, and/or other changes which will fall within the purview of the subject invention and claims.

What is claimed is:

1. An inertial force exercise device with dense body extremities for exercising the body by maximizing the effort required to overcome the inertia of mass being accelerated and translated during surface oscillations while simultaneously minimizing the effort required to overcome the rotational inertia of mass, said exercise device comprising:

a first wheel operable to engage, roll, and be accelerated upon a surface during an exercise routine and constructed in a manner to facilitate rapid acceleration and minimize torque;

a second wheel operable to engage, roll, and be accelerated upon a surface during an exercise routine and constructed in a manner to facilitate rapid acceleration and minimize torque;

a body connected to said first wheel at a first extremity of said body and to said second wheel at a second extremity of said body, said first and second wheels connected at their hubs in a mutually parallel posture on the center line of the length of said body, said body having a central section between said extremities of said body for controlling the operation of the device, with the distance from any point on said body measured perpendicularly to the center line of said body being shorter than the perpendicular distance from any point on the circumference of said first and second wheels measured perpendicularly to the center line of said body, with any diameter of said first and second wheels being perpendicular to said center line; and with at least a part of said first extremity of said body being denser than the mass of said first wheel and wherein said at least a part of said first extremity comprises at least one unitary structure heavier than said first wheel and with at least a part of said second extremity of said body being denser than the mass of said second wheel and wherein said at least a part of said second extremity comprises at least one unitary structure heavier than said second wheel.

2. An inertial force exercise device with dense body extremities for exercising the body as defined in claim 1 wherein:

said first extremity comprises a first axle and a first inertial mass connected to said first axle and said second extremity comprises a second axle and a second inertial mass connected to said second axle, the length of said first and second axles lying along the length of said center line of said body and wherein said at least a part of said first extremity of said body comprises at least said first inertial mass and wherein said at least a part of said second extremity of said body comprises at least said second inertial mass,

3. An inertial force exercise device with dense body extremities for exercising the body as defined in claim 2 wherein:

each of said first and second axles is denser than said central section of said body

4. An inertial force exercise device with dense body extremities for exercising the body as defined in claim 2 wherein:

each of said first and second inertial masses is denser than said central section of said body.

5. An inertial force exercise device with dense body extremities for exercising the body as defined in claim 2 wherein:

said first and second inertial masses are respectively first and second discs, each of said discs mounted at the hub on each of said axles in a mutually parallel posture adjacent to each of said wheels, with any diameter of said first and second discs being perpendicular to said center line of said body.

6. An inertial force exercise device with dense body extremities for exercising the body as defined in claim 5 wherein: said first disc is mounted outside of said first wheel and said second disc is mounted outside of said second wheel.

7. An inertial force exercise device with dense body extremities for exercising the body as defined in claim 5 wherein:

said first disc is mounted inside of said first wheel and said second disc is mounted inside of said second wheel.

8. An inertial force exercise device with dense body extremities for exercising the body as defined in claim 2 wherein:

each of said first and second extremities is denser than said central section of said body.

9. An inertial force exercise device with dense body extremities for exercising the body as defined in claim 8, 3, or 4 wherein: said central section of said body is a tube whose length extends between said extremities of said body and lies along the length of said center line of said body.

10. An inertial force exercise device with dense body extremities for exercising the body by maximizing the effort required to overcome the inertia of mass being accelerated and translated during surface oscillations while simultaneously minimizing the effort required to overcome the rotational inertial of mass, said exercise device comprising:

a first wheel operable to engage, roll, and be accelerated upon a surface during an exercise routine and constructed in a manner to facilitate rapid acceleration and minimize torque;

a second wheel operable to engage, roll, and be accelerated upon a surface during an exercise routine and constructed in a manner to facilitate rapid acceleration and minimize torque; and a body connected to said first wheel at a first extremity of said body and to said second wheel at a second extremity of said body, said first and second wheels connected at their hubs in a mutually parallel posture on the center line of the length of said body, said body having a central section between said extremities of said body for controlling the operation of the device, with the distance from any point on said body measured perpendicularly to the center line of said body being shorter than the perpendicular distance from any point on the circumference of said first and second wheels measured perpendicularly to the center line of said body, with any diameter of said first and second wheels being perpendicular to said center line; and with at least a part of said first extremity of said body being denser than the mass of said central section of said body and being at a location on said center line of said body between said central section and said first wheel and with at least a part of said second extremity of said body being denser than the mass of said central section of said body and being at a location on said center line of said body between said central section and said second wheel.

11. An inertial force exercise device with dense body extremities for exercising the body as defined in claim 10 wherein:

said first extremity comprises a first axle and a first inertial mass connected to said first axle and said second extremity comprises a second axle and a second inertial mass connected to said second axle, the length of said first and second axles lying along the length of said center line of said body and wherein said at least a part of said first extremity of said body comprises at least said first inertial mass and wherein said at least a part of said second extremity of said body comprises at least said second inertial mass.

12. An inertial force exercise device with ,dense body extremities for exercising the body as defined in claim 11 wherein:

each of said first and second axles is denser than said central section of said body.

13. An inertial force exercise device with dense body extremities for exercising the body as defined in claim 11 wherein:

said first and second inertial masses are respectively first and second discs, each of said discs mounted at the hub on each of said axles in a mutually parallel posture adjacent to each of said wheels, with any diameter of said first and second discs being perpendicular to said center line of said body.

14. An inertial force exercise device with dense body extremities for exercising the body as defined in claim 11 wherein:

the mass of each of said first and second extremities is denser than mass of said first and second wheels.

15. An inertial force exercise device with dense body extremities for exercising the body as defined in claims 12 or 14 wherein:

said central section of said body is a tube whose length extends between said extremities of said body and lies along the length of said center lie of said body.

16. An inertial force exercise device with dense body extremities for exercising the body as defined in claim 13 wherein:

the mass of each of said first and second inertial masses is denser than the mass of said first and second wheels.

17. An inertial force exercise device with dense body extremities for exercising the body as defined in claim 12 wherein:

the mass of each of said first and second axles is denser than mass of said first and second wheels.

18. A inertial force exercise device with dense body extremities for exercising the body by maximizing the effort required to overcome the inertial of mass being accelerated and translated during surface oscillations while simultaneously minimizing the effort required to overcome the rotational inertial of mass, said exercise device comprising:

a first wheel operable to engage, roll, and be accelerated upon a surface during an exercise routine an constructed in a manner to facilitate rapid acceleration and minimize torque;

a second wheel operable to engage, roll, and be accelerated upon a surface during an exercise routine and constructed in a manner to facilitate rapid acceleration and minimize torque;

a body connected to said first wheel at a first extremity of said body and to said second wheel at a second extremity of said body, said first and second wheels connected at their hubs in a mutually parallel posture on the center line of the length of said body, said body having a central section between said extremities of said body for controlling the operation of the device, with the distance from any point on said body measured perpendicularly to the center line of said body being shorter than the perpendicular distance from any point on the circumference of said first and second wheels measured perpendicularly to the center line of said body, with any diameter of said first and second wheels being perpendicular to said center line; and with at least a part of said first extremity of said body being denser than the mass of said central section of said body and wherein said at least a part of said first extremity comprises at least one unitary structure heavier than said first wheel and with at least a part of said second extremity of said body being denser than the mass of said central section of said body and wherein said at least a part of said second extremity comprises at least one unitary structure heavier than said second wheel; and means for eliminating the transfer of torque from said first wheel to said at least a part of said first extremity of said body while said first wheel is rotating and for minimizing or eliminating the transfer of torque from said second wheel to said at least a part of said second extremity of said body while said second wheel is rotating.

19. An inertial force exercise device with dense body extremities for exercising the body as defined in claim 18, wherein:

the mass of each of said first and second extremities is denser than mass of said first and second wheels.

20. An inertial force exercise device with dense body extremities for exercising the body as defined in claim 18 wherein:

the mass of each of said first and second axles is denser than mass of said first and second wheels.

21. An inertial force exercise device with dense body extremities for exercising the body as defined in claim 18 wherein:

the mass of each of said first and second inertial masses is denser than the mass of said first and second wheels.

22. An inertial force exercise device with dense body extremities for exercising the body as defined in claim 18 wherein:

said first extremity comprises a first axle and a first inertial mass connected to said first axle and said second extremity comprises a second axle and a second inertial mass connected to said second axle, the length of said first and second axles lying along the length of said center line of said body and wherein said at least a part of said first extremity of said body comprises at least said first inertial mass and wherein said at least a part of said second extremity of said body comprises at least said second inertial mass.

23. An inertial force exercise device with dense body extremities for exercising the body as defined in claim 22 wherein:

said first and second inertial masses are respectively first and second discs, each of said discs mounted at the hub on each of said axles in a mutually parallel posture adjacent to each of said wheels, with any diameter of said first and second discs being perpendicular to said center line of said body.

24. An inertial force exercise device with dense body extremities for exercising the body as defined in claim 22 wherein:

each of said first and second axles is denser than said central section of said body.

25. An inertial force exercise device with dense body extremities for exercising the body as defined in claim 22 wherein:

said central section of said body is a tube whose length extends between said extremities of said body and lies along the length of said center line of said body.

26. An inertial force exercise device with dense body extremities for exercising the body as defined in claim 23 wherein:

said means for eliminating the transfer of torque from said first wheel to said at least a part of said first extremity of said body while said first wheel is rotating comprises a flange on said hub of said first wheel oriented toward said first disc and said means for minimizing or eliminating the transfer of torque from said second wheel to said at least a part of said second extremity of said body while said second wheel is rotating comprises a flange on said of said second wheel oriented toward said second disc.

27. An inertial force exercise device with dense body extremities for exercising the body as defined in claim 23 wherein:

said means for eliminating the transfer of torque from said first wheel to said at least a part of said first extremity of said body while said first wheel is rotating comprises a flange on said hub of said first disc oriented toward said first wheel and said means for minimizing or eliminating the transfer of torque from said second wheel to said at least a part of said second extremity of said body while said second wheel is rotating comprises a flange on said hub of said second disc oriented toward said second wheel.

28. An inertial force exercise device with dense body extremities for exercising the body as defined in claim 23 wherein:

said means for eliminating the transfer of torque from said first wheel to said at least a part of said first extremity of said body while said first wheel is rotating is a convex face on aid first disk oriented toward said first wheel and said means for minimizing or eliminating the transfer of torque from said second wheel to said at least a part of said second extremity of said body while and second wheel is rotating is a convex face on said second disc oriented toward said second wheel.

29. An inertial force exercise device with dense body extremities for exercising the body as defined in claim 23 wherein:

said means for eliminating the transfer of torque from said first wheel to said at least a part of said first extremity of said body while said first wheel is rotating is a washer on said axle between said first disc and said first wheel and said means for minimizing or eliminating the transfer of torque from said second wheel to said at least a part of said second extremity of said body while said second wheel is rotating is a washer on said axle between said second disc and said second wheel.

30. An inertial force exercise device with dense body extremities for exercising the body as defined in claim 23 wherein:

said means for eliminating the transfer of torque from said first wheel to said at least a part of said first extremity of said body while said first wheel is rotating is a lubricant applied to the face of the hub of said first wheel oriented toward said first disc and said means for minimizing or eliminating the transfer of torque from said second wheel to said at least a part of said second extremity of said body while said second wheel is rotating is a lubricant applied to the face of the hub of said second wheel oriented toward said second disc.

31. An inertial force exercise device with dense body extremities for exercising the body as defined in claim 26 27, 28, 29, or 30 wherein:

said first disc is mounted outside of said first wheel and said second disk is mounted outside of said second wheel.

32. An inertial force exercise device with dense body extremities for exercising the body as defined in claim 26, 27, 28, 29, or 31 wherein:

said first disc is mounted inside of said first wheel and said second disc is mounted inside of said second wheel.

* * * * *